US008773325B2

(12) United States Patent
Chiang

(10) Patent No.: US 8,773,325 B2
(45) Date of Patent: Jul. 8, 2014

(54) ANTENNA DEVICE

(75) Inventor: Kun-Tien Chiang, Tainan (TW)

(73) Assignee: Mascot Electric Co., Ltd., Tainan (TW)

( * ) Notice: Subject to any disclaimer, the term of this patent is extended or adjusted under 35 U.S.C. 154(b) by 232 days.

(21) Appl. No.: 13/476,706

(22) Filed: May 21, 2012

(65) Prior Publication Data

US 2013/0050051 A1 Feb. 28, 2013

(30) Foreign Application Priority Data

Aug. 31, 2011 (TW) ..... 100216270 U

(51) Int. Cl.
*H01Q 1/42* (2006.01)

(52) U.S. Cl.
USPC ..... 343/872; 343/900; 343/715

(58) Field of Classification Search
CPC ..... H01Q 1/42; H01Q 9/30; H01Q 1/3275
USPC ..... 343/872, 900, 715
See application file for complete search history.

(56) References Cited

U.S. PATENT DOCUMENTS 6,486,843 B2 * 11/2002 Wang et al. ..... 343/715
8,134,520 B2 * 3/2012 Noro et al. ..... 343/906
8,610,631 B2 * 12/2013 Lindenmeier et al. ..... 343/715

* cited by examiner

*Primary Examiner* — Hoang V Nguyen
(74) *Attorney, Agent, or Firm* — Foley & Lardner LLP; Andrew S. Baluch

(57) ABSTRACT

An antenna device includes: an upright antenna rod connected electrically to and extending upward from a connector; an outer casing mounted on the connector for covering the antenna rod; and a conductive member disposed in the outer casing. The conductive member has an intermediate connecting portion connected electrically to a top of the antenna rod, and two spaced apart sensing portions extending respectively and downward from opposite sides of the intermediate connecting portion toward the connector such that the antenna rod is disposed between the sensing portions.

7 Claims, 10 Drawing Sheets

ANTENNA DEVICE

CROSS-REFERENCE TO RELATED APPLICATION

This application claims priority to Taiwanese Application No. 100216270, filed on Aug. 31, 2011.

BACKGROUND OF THE INVENTION

1. Field of the Invention

The invention relates to an antenna device for transceiving radio signals.

2. Description of the Related Art

Referring to FIGS. 1 and 2, a conventional antenna device 1 is shown to include: a connector 11; an upright antenna rod 12 connected electrically to and extending upward from the connector 11; an outer sleeve body 14 mounted on the connector 11 and permitting extension of the antenna rod 12 therethrough; a copper tube 15 mounted on and surrounding the antenna rod 12, and having a closed upper end 151 that contacts electrically a tip of the antenna rod 12, and an open lower end 152 extending into the outer sleeve body 14; and a tubular outer cap 16 mounted on the outer sleeve body 14 for covering the copper tube 15.

The conventional antenna device 1 is capable of transceiving electromagnetic waves, the frequencies of which are determined based on a resonance frequency created by the antenna rod 12 and the copper tube 15. In other words, the resonance frequency is associated with an inner diameter and a length of the copper tube 15. Therefore, if the conventional antenna device 1 is designed to have a different frequency band, the size of the copper tube 15 should be changed. However, since the copper tube 15 is fabricated through a lathe procedure, it is difficult to exactly control the size of the cooper tube 15. Moreover, since the copper tube 15 has a certain thickness, the conventional antenna device 1 has a relatively high cost.

SUMMARY OF THE INVENTION

Therefore, an object of the present invention is to provide an antenna device that can overcome the aforesaid drawbacks of the prior art.

According to the present invention, an antenna device comprises:

a connector;

an upright antenna rod connected electrically to and extending upward from the connector;

an outer casing mounted on the connector for covering the antenna rod; and a conductive member disposed in the outer casing, the conductive member having an intermediate connecting portion connected electrically to a top of the antenna rod, and two spaced apart sensing portions extending respectively and downward from opposite sides of the intermediate connecting portion toward the connector such that the antenna rod is disposed between the sensing portions.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
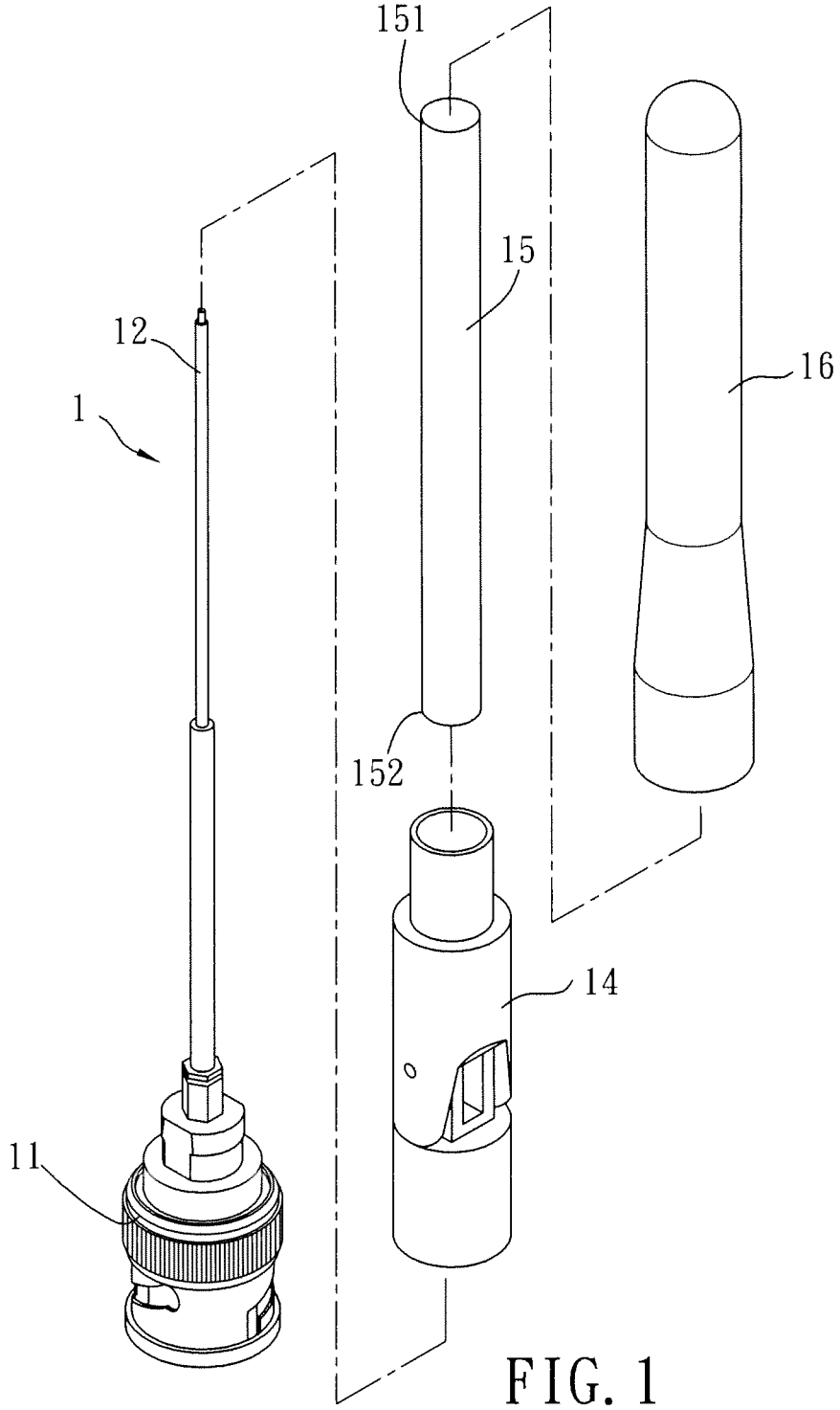
FIG. 1 PRIOR ART
FIG. 1 is a partly exploded perspective view showing a conventional antenna device.
Figure 2:
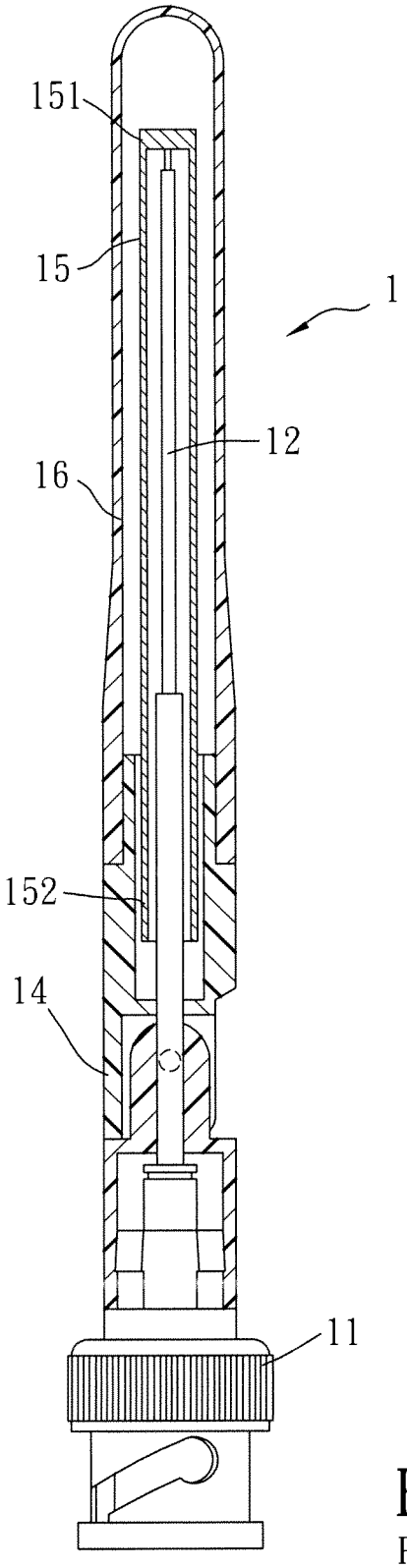
FIG. 2 PRIOR ART
FIG. 2 is a partly schematic sectional view showing the conventional antenna device.

Before the present invention is described in greater detail, it should be noted that like elements are denoted by the same reference numerals throughout the disclosure.

Figure 3:
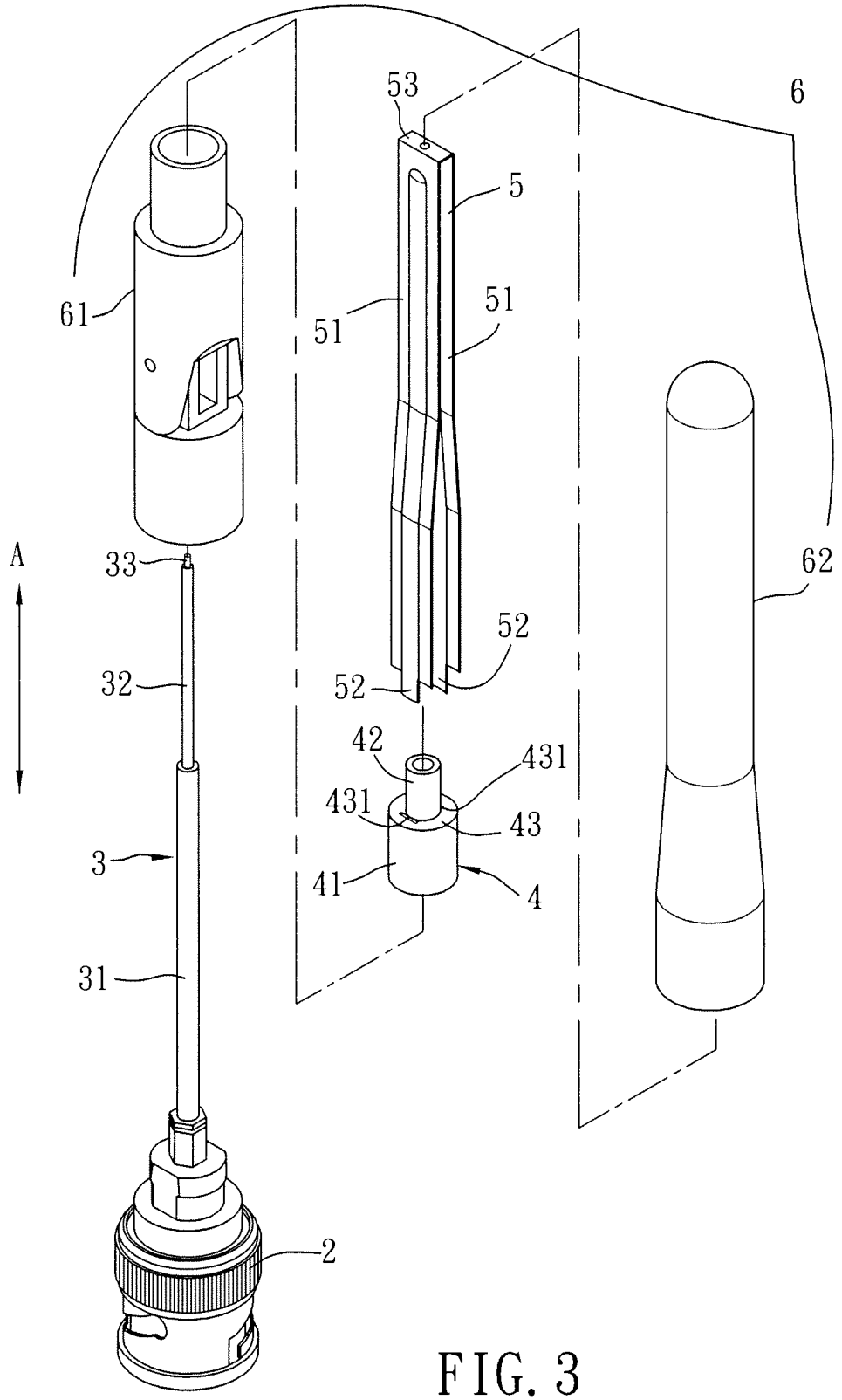
FIG. 3 is a partly exploded perspective view showing the first preferred embodiment of an antenna device according to the present invention.
Figure 4:
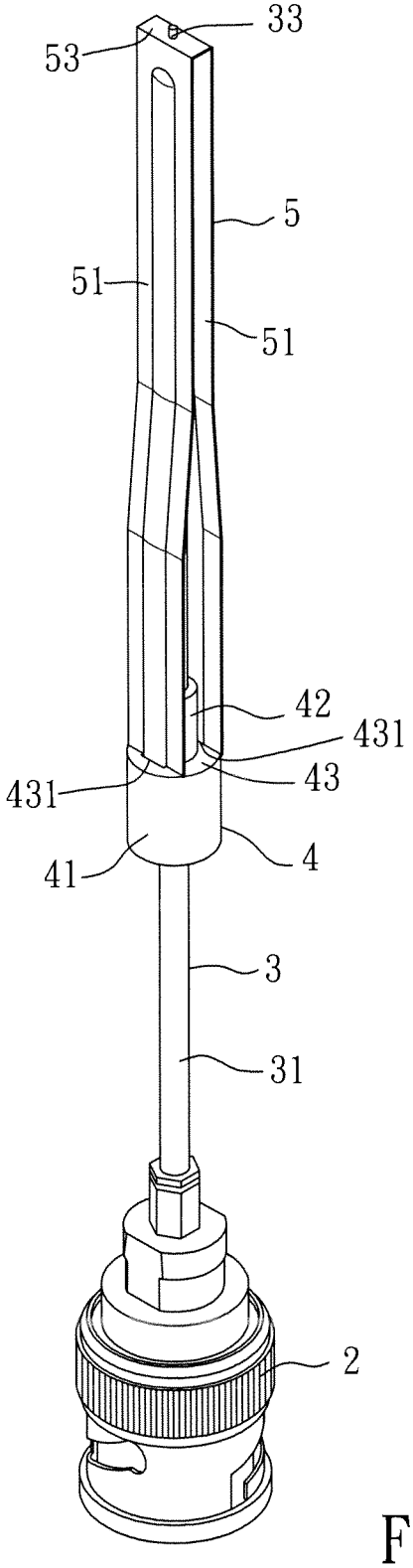
FIG. 4 is an assembled perspective view showing the first preferred embodiment without an outer casing.
Figure 5:
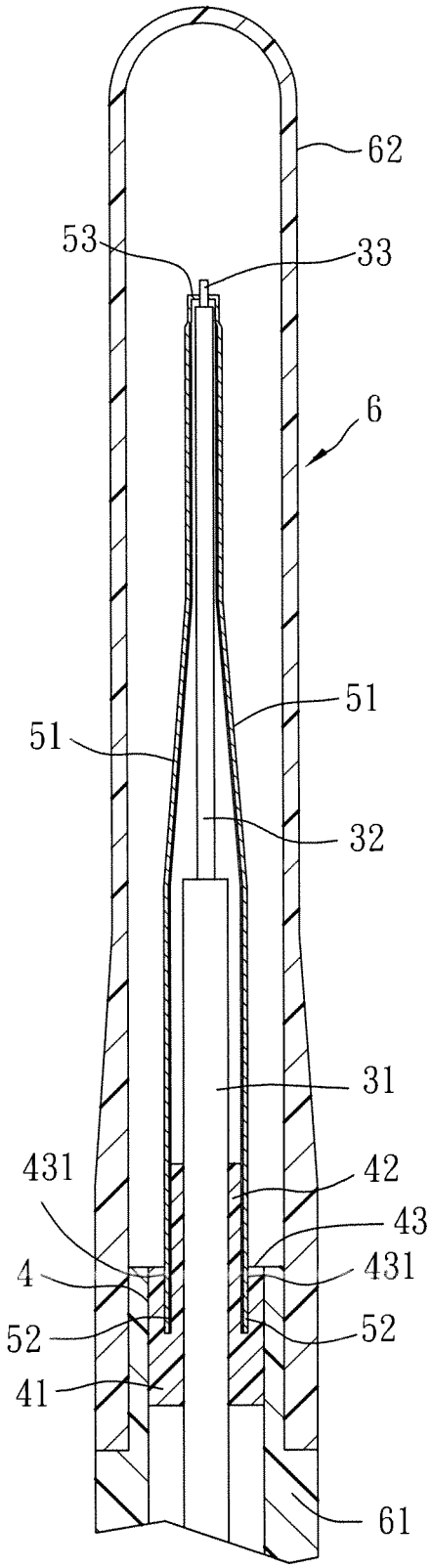
FIG. 5 is a fragmentary partly schematic sectional view showing the first preferred embodiment.

Referring to FIGS. 3 to 5, the first preferred embodiment of an antenna device according to the present invention is shown to include a connector 2, an upright antenna rod 3, an outer casing 6, a conductive member 5, and an insulating positioning seat 4. The antenna device is adapted to be used with an electronic apparatus, such as a wireless microphone receiver, a digital TV set-top box or a router.

The connector 2 is adapted to be connected electrically to the electronic apparatus.

The antenna rod 3 is connected electrically to and extends upward from the connector 2. In this embodiment, the antenna rod 3 has a first rod section 31, a second rod section 33, and a third rod section 32. The first rod section 31 is connected electrically to the connector 31. The second rod section 33 is opposite to the first rod section 31 in an axial direction of the antenna rod 3, and serves as a top of the antenna rod 3. The third rod section 32 interconnects the first and second rod sections 31, 33, and has a diameter smaller than that of the first rod section 31 but larger than that of the second rod section 33.

The outer casing 6 is mounted on the connector 2 for covering the antenna rod 3. In this embodiment, the outer casing 6 includes a sleeve body 61, and a tubular cap body 62. The sleeve body 61 is mounted on the connector 2, and permits extension of the antenna rod 3 therethrough such that an upper part of the first rod section 31, the third rod section 32 and the second rod section 33 of the antenna rod 3 extend outward of the sleeve body 61. The cap body 62 is mounted on the sleeve body 61 for covering the antenna rod 3.

The positioning seat 4 is made from an insulating material, and is mounted on the antenna rod 3 for positioning the conductive member 5. In this embodiment, the positioning seat 4 is in the form of a tube body, and is sleeved fixedly on the first rod section 31 of the antenna rod 3. The positioning seat 4 has a large-diameter first tube portion 41 extending into the sleeve body 61 of the outer casing 6 (see FIG. 5), a small-diameter second tube portion 42, and an annular shoulder 43 between the first and second tube portions 41, 42. The annular shoulder 43 is formed with opposite positioning grooves 431.

The conductive member 5 is disposed in the outer casing 6, and has an intermediate connecting portion 53 and two spaced apart sensing portions 51. The intermediate connecting portion 53 is connected electrically to the second rod section 33 of the antenna rod 3. The sensing portions 51 extend respectively and downward from opposite sides of the intermediate connecting portion 53 toward the connector 2. In this embodiment, the conductive member 5 is in the form of a bent metal plate. Each sensing portion 51 has a bottom end abutting against the annular shoulder 43 of the positioning seat 4. The upper part of the first rod section 31 and the third rod section 32 of the antenna rod 3, and the second tube portion 42 of the positioning seat 4 are disposed between the sensing portions 51. In addition, the conductive member 5 further has two positioning protrusions 52 that extend respectively and downward from the bottom ends of the sensing portions 51 into the positioning grooves 431 in the annular shoulder 43 of the positioning seat 4 so as to position the sensing portions 51 of the conductive member 5 on the positioning seat 4.

In such a configuration, since the conductive member 4 has a sheet structure, the antenna device of the present invention can be fabricated at lower cost compared to the aforesaid conventional antenna device with the copper tube 15. On the other hand, the size of each sensing portion 51 of the conductive member 4 and a largest distance between the sensing portions 51 of the conductive member 4, i.e., the distance between the positioning grooves 431 in the positioning seat 4, can be easily designed to meet a desired resonance frequency of the antenna device. In addition, since the conductive member 4 with the sheet structure has a relatively large impedance, the antenna device of the present invention has an widened operating frequency width such that the antenna device can be easily designed to have various frequency bands that conform to requirements for different communication equipments.

Figure 6:
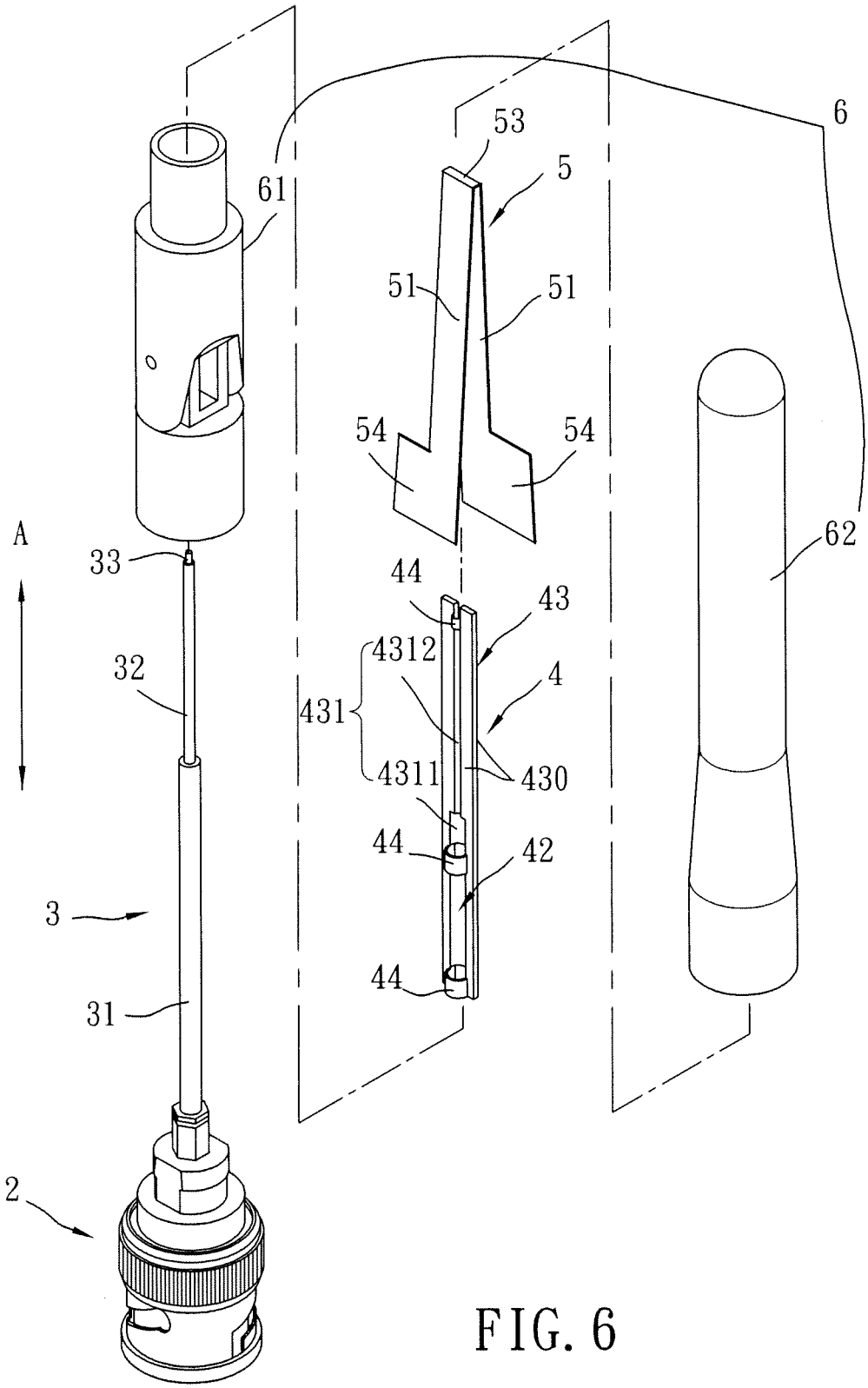
FIG. 6 is a partly exploded perspective view showing the second preferred embodiment of an antenna device according to the present invention.
Figure 7:
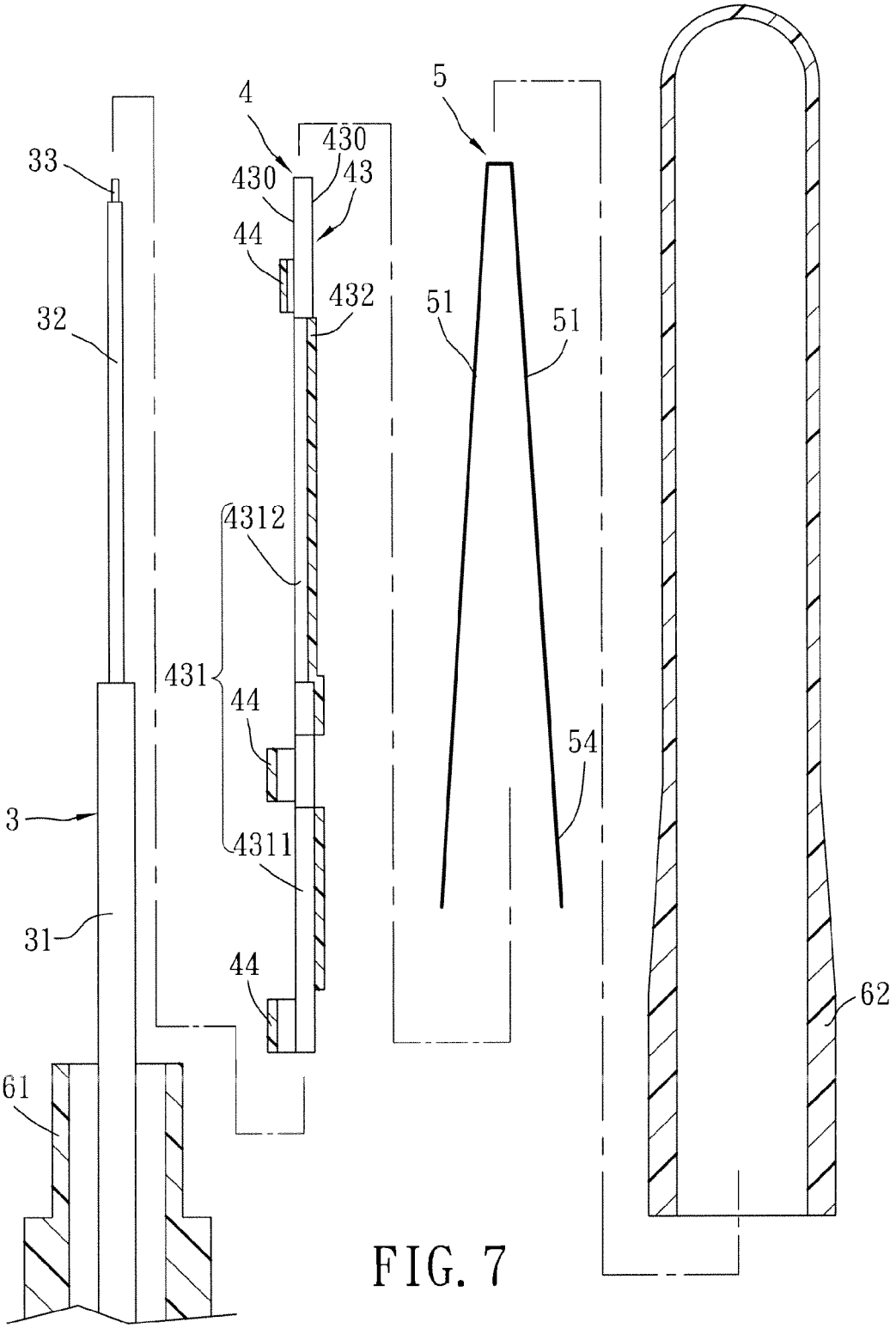
FIG. 7 is a partly exploded, fragmentary partly schematic sectional view showing the second preferred embodiment without a connector.
Figure 8:
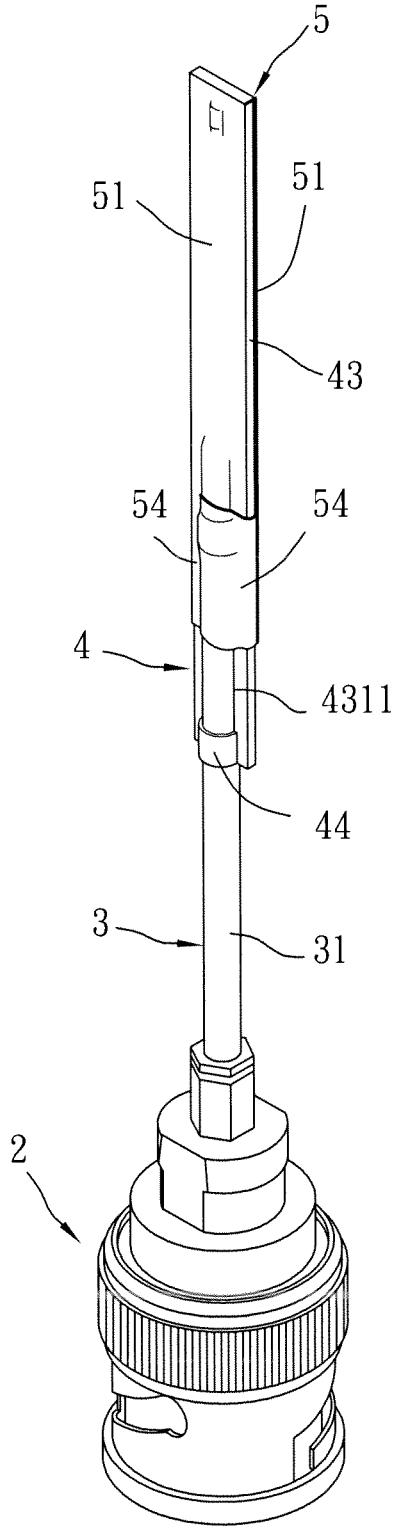
FIG. 8 is an assembled perspective view showing the second preferred embodiment without an outer casing.

FIGS. 6 to 8 illustrate the second preferred embodiment of an antenna device according to this invention, which is a modification of the first preferred embodiment.

In this embodiment, the positioning seat 4 includes an upright plate body 43, and a plurality of spaced apart curved anchoring members 44.

The plate body 43 has opposite side surfaces 430, one of which is formed with a receiving groove 431 that extends in the axial direction (A) and that is defined by a concave wall 432 extending in the axial direction (A). The receiving groove 431 includes a lower first groove portion 4311, and an upper second groove portion 4312 having a largest width smaller than that of the first groove portion 4311.

The anchoring members 44 are provided on said one of the side surfaces 430 of the plate body 43, and are disposed across the receiving groove 431 such that a mounting hole is confined among the concave wall 432 of the plate body 43 and the anchoring members 44, and permits extension of the antenna rod 3 therethrough to thereby sleeve fittingly the positioning seat 4 on the antenna rod 3. In this case, the upper part of the first rod section 31 of the antenna rod 3 is fittingly received in the first groove portion 4311 of the receiving groove 431, and the third rod section 32 of the antenna rod 3 is fittingly received in the second groove portion 4312. In this embodiment, each anchoring member 44 is in the form of a semicircular ring.

In this embodiment, the conductive member 5 is in the form of a flexible metal plate. The intermediate connecting portion 53 of the conductive member 5 is attached over a top end of the plate body 43. The sensing portions 51 of the conductive member 5 are respectively attached over the side surfaces 430 of the plate body 43 of the positioning seat 4 such that the antenna rod 3 is partly covered. The conductive member 4 further has two extensions 54 extending from the sensing portions 51, wound on the positioning seat 4 and overlapping each other such that the conductive member 4 is fixed to the positioning seat 4.

Figure 9:
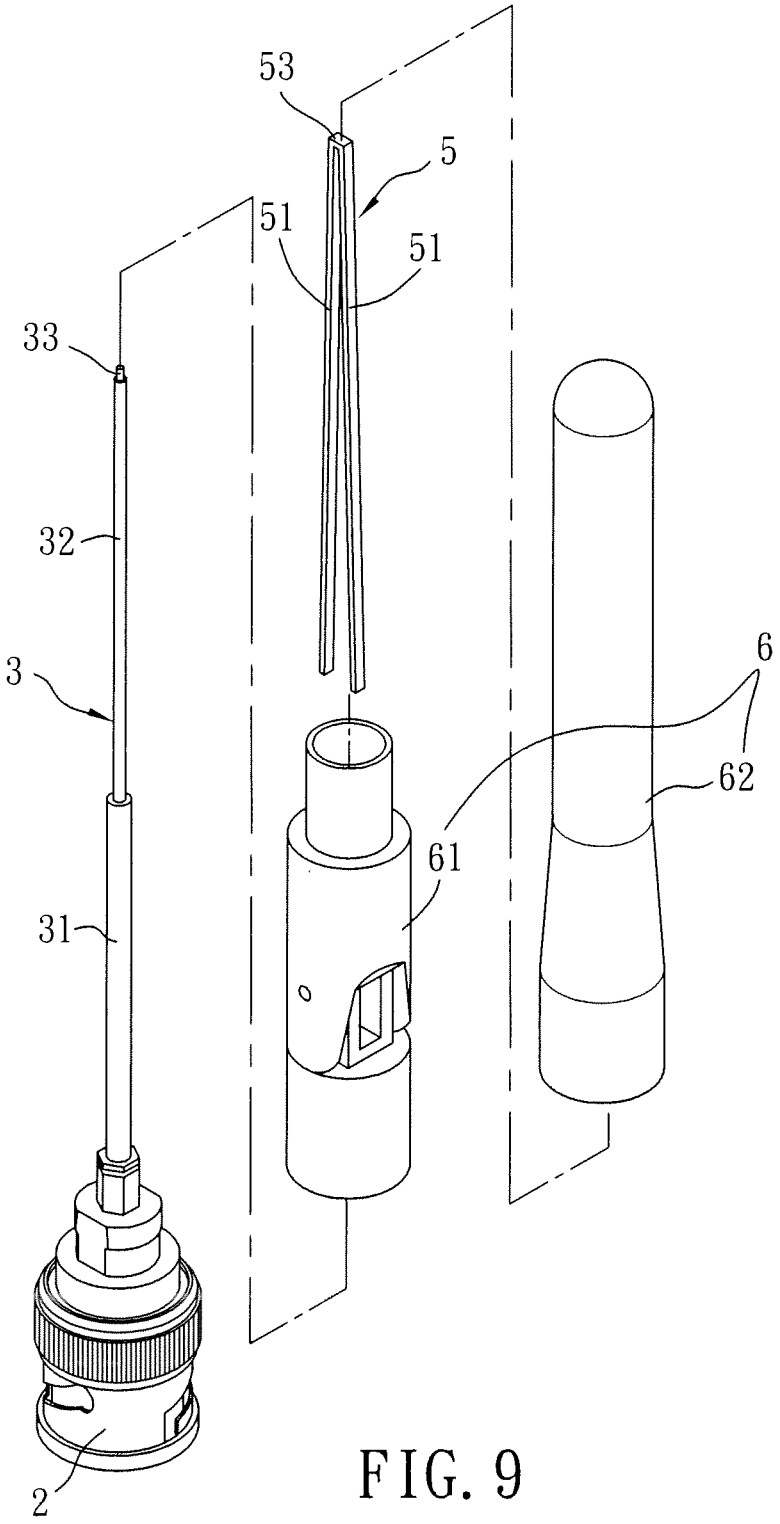
FIG. 9 is a partly exploded perspective view showing the third preferred embodiment of an antenna device according to the present invention.
Figure 10:
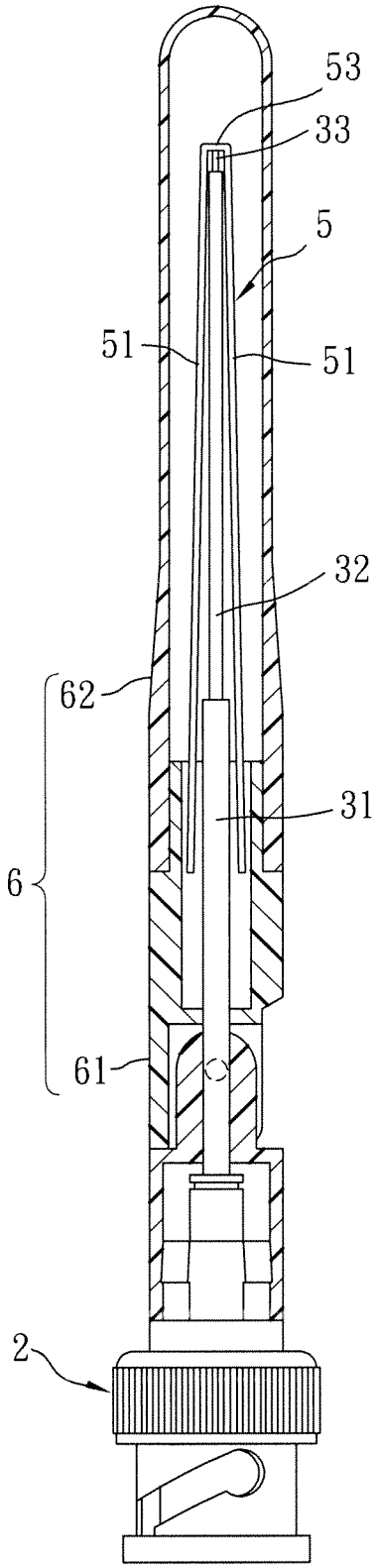
FIG. 10 is a partly schematic sectional view showing the third preferred embodiment.

FIGS. 9 and 10 illustrate the third preferred embodiment of an antenna device according to this invention, which is a modification of the first preferred embodiment. Unlike the first preferred embodiment, the positioning seat 4 is omitted. In addition, the conductive member 5 is in the form of a bent metal rod. The intermediate connecting portion 53 of the conductive member 5 is soldered to the second rod section 33 of the antenna rod 3.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna device comprising:

a connector;

an upright antenna rod connected electrically to and extending upward from said connector;

an outer casing mounted on said connector for covering said antenna rod; and a conductive member disposed in said outer casing, said conductive member having an intermediate connecting portion connected electrically to a top of said antenna rod, and two spaced apart sensing portions extending respectively and downward from opposite sides of said intermediate connecting portion toward said connector such that said antenna rod is disposed between said sensing portions.

2. The antenna device as claimed in claim 1, further comprising an insulating positioning seat mounted on said antenna rod for positioning said conductive member thereon.

3. The antenna device as claimed in claim 2, wherein:

said positioning seat is in the form of a tube body, is sleeved fixedly on said antenna rod, and has a large-diameter first tube portion, a small-diameter second tube portion disposed between said sensing portions of said conductive member, and an annular shoulder between said first and second tube portions, said annular shoulder being formed with opposite positioning grooves; and said conductive member is in the form of a bent metal plate, and further has two positioning protrusions that extend respectively and downward from said sensing portions into said positioning grooves in said annular shoulder of said positioning seat so as to position said sensing portions of said conductive member on said positioning seat.

4. The antenna device as claimed in claim 2, wherein:

said positioning seat includes an upright plate body having opposite side surfaces, one of which is formed with a receiving groove that extends in an axial direction of said antenna rod and that is defined by a concave wall extending in the axial direction, and a plurality of spaced apart curved anchoring members provided on said one of said side surfaces of said plate body and disposed across said receiving groove such that a mounting hole is confined among said concave wall of said plate body and said anchoring members, and permits extension of said antenna rod therethrough to thereby sleeve fittingly said positioning seat on said antenna rod; and said conductive member is in the form of a flexible metal plate, said intermediate connecting portion of said conductive member being attached over a top end of said plate body of said positioning seat, said sensing portions of said conductive member being respectively attached over said side surfaces of said plate body of said positioning seat, said conductive member further having two extensions extending respectively from said sensing portions, wound on said plate body of said positioning seat and overlapping each other, thereby positioning said conductive member on said positioning seat.

5. The antenna device as claimed in claim 4, wherein each of said anchoring members is in the form of a semicircular ring.

6. The antenna device as claimed in claim 4, wherein:

said antenna rod has a first rod section connected electrically to said connector, a second rod section opposite to said first rod section in the axial direction and serving as said top of said antenna rod, and a third rod section interconnecting said first and second rod sections and having a diameter smaller than that of said first rod section but larger than that of said second rod section; and said receiving groove in said plate body of said positioning seat includes a lower first groove portion for fittingly receiving an upper part of said first rod section of said antenna rod, and an upper second groove portion for fittingly receiving said third rod section of said antenna rod.

7. The antenna device as claimed in claim 1, wherein said conductive member is in the form of a bent metal rod.

* * * * *